US008611791B2

(12) United States Patent
Tokuyama et al.

(10) Patent No.: US 8,611,791 B2
(45) Date of Patent: Dec. 17, 2013

(54) ROLLER REPLACEMENT AUXILIARY TOOL OF A FIXING UNIT THAT PROTECTS A ROLLER

(75) Inventors: Kohji Tokuyama, Ibaraki (JP); Yutaka Nagasawa, Ibaraki (JP); Genichiro Kawamichi, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 300 days.

(21) Appl. No.: 13/012,316

(22) Filed: Jan. 24, 2011

(65) Prior Publication Data

US 2011/0188883 A1 Aug. 4, 2011

(30) Foreign Application Priority Data

Jan. 29, 2010 (JP) ..... 2010-018762

(51) Int. Cl.
*G03G 15/20* (2006.01)

(52) U.S. Cl.
USPC ..... 399/122

(58) Field of Classification Search
USPC ..... 399/122
See application file for complete search history.

(56) References Cited

U.S. PATENT DOCUMENTS 4,121,089 A * 10/1978 Bishop ..... 219/216
4,888,620 A * 12/1989 Fujino et al. ..... 399/110
5,301,000 A 4/1994 Heigl
6,442,360 B1 8/2002 Onodera et al.
6,490,425 B2 * 12/2002 Konday et al. ..... 399/107
2010/0172671 A1 7/2010 Onodera et al.

FOREIGN PATENT DOCUMENTS

| | | |
|---|---|---|
| JP | 1-221777 | 9/1989 |
| JP | 2-120881 | 5/1990 |
| JP | 03-266871 | 11/1991 |
| JP | 3-267974 | 11/1991 |
| JP | 4-184380 | 7/1992 |
| JP | 4-208975 | 7/1992 |
| JP | 5-504633 | 7/1993 |
| JP | 5-289564 | 11/1993 |
| JP | 09-080948 | 3/1997 |
| JP | 2001-143520 | 5/2001 |
| JP | 2002-23535 | 1/2002 |
| JP | 2002-221873 | 8/2002 |
| JP | 2002-278336 | 9/2002 |
| JP | 2006-251414 | 9/2006 |
| JP | 2010-181858 | 8/2010 |

* cited by examiner

*Primary Examiner* — Quana M Grainger
(74) *Attorney, Agent, or Firm* — Oblon, Spivak, McClelland, Maier & Neustadt, L.L.P.

(57) ABSTRACT

Disclosed is a roller replacement auxiliary tool of a fixing unit for extracting at least one of a heating roller and a pressure roller from a replacement opening part formed in a frame of the fixing unit in a shaft direction so as to be replaced. The heating roller has a heater lamp provided therein, and the pressure roller is capable of being brought into press-contact with the heating roller. The roller replacement auxiliary tool includes a protection unit that protects the roller when the roller is replaced.

7 Claims, 21 Drawing Sheets

ROLLER REPLACEMENT AUXILIARY TOOL OF A FIXING UNIT THAT PROTECTS A ROLLER

BACKGROUND OF THE INVENTION

1. Field of the Invention

The present invention relates to a roller replacement auxiliary tool for replacing a roller of a fixing unit in an image forming apparatus such as a laser beam printer.

2. Description of the Related Art

A known fixing unit of an image forming apparatus such as a laser beam printer and a copier fixes an unfixed toner image on a recording medium by heating and pressing the recording medium maintaining the toner image on its front surface while conveying the same so as to be held between a heating roller and a pressure roller.

Inside the heating roller, plural heater lamps are provided as heat sources. Generally, image forming apparatuses whose print speed is fast and that are adapted to store high ream weight recording media require high heat capacity for fixing a toner image and thus have to maintain the heating roller at a certain temperature or higher, which in turn requires a higher fixing temperature.

When a maintenance technician replaces the heating roller because the heating roller maintained at high temperature comes to the end of its service life, he or she stops the operations of the image forming apparatus, extracts the heating roller from the fixing unit after causing the heating roller itself to be cooled to a certain level enough to perform a replacement operation, and replaces the heating roller with a new one. In this case, however, it takes time to cool the heating roller and greatly reduces operating efficiency. In addition, this causes not only the degradation of the operating efficiency because the image forming apparatus is stopped for a long time, but also a large expense for replacement maintenance operations.

Recently, there has been demanded for the image forming apparatuses adapted to high print speed, high image quality, and various sheets. Furthermore, it has been requested that the fixing unit use some types of heating rollers such as one that has a thin PFA (tetrafluoroethylene-perfluoroalkyl vinyl ether copolymer) resin or the like coated on its front surface layer for the purpose of promptly supplying heat required for fixing a toner image when high print speed is demanded, one that has a silicon rubber or the like coated on its front surface layer for the purpose of minimizing the damage and bleeding of a toner image at fixation when high image quality is demanded, and one that has a PFA tube or the like coated on a silicon rubber layer when image quality having a certain degree and roller durability are demanded.

In order to respond to such a demand in the image forming apparatus, the heating roller must be changed correspondingly. Although there is some difference depending on the types, the heating roller has basically a high heat capacity and takes a long time to cool so as to be replaceable from a high temperature state at which the heating roller is maintained to supply the heat required for optimum toner fixation.

The replacement of the heating roller is discussed in, for example, Patent Document 1.

FIGS. 1 and 2 are a partial cross-sectional view of the fixing unit described in Patent Document 1 and a perspective view of the fixing unit showing the heating roller being replaced.

FIG. 1 is the partial cross-sectional view of the fixing unit described in Patent Document 1. As shown in FIG. 1, one end of the heating roller 100 is supported by a frame 102 through a support flange 101. The support flange 101 has a bearing 103, and the bearing 103 is fitted in the opening end of the heating roller 100 together with a centering member 104. Although not shown in FIG. 1, the other end of the heating roller 100 is also supported by a support flange through a bearing.

The support flange 101 is fixed to the frame 102 through a wing screw 106. The support flange 101 is fixed to a holding claw 108 through a wing screw 107, and the holding claw 108 is used for setting the position of the heating roller 100 when the heating roller 100 is replaced.

Inside the heating roller 100, plural radiator modules 105 are arranged. First ends of the plural radiator modules 105 are held at the center of the support flange 101 through the holding member 109. Although not shown in FIG. 1, the other ends of the plural radiator modules 105 are also indirectly supported by the support flange through a holding member.

As shown in FIG. 1, a connector 110 provided at the ends of the plural radiator modules 105 is projected outward more than the support flange 101 where the plural radiator modules 105 are held at the center of the support flange 101. The support flange 101 is integrally provided with a grip 111 for replacing the heating roller 100. The grip 111 is provided so as to straddle the connector 110 of the plural radiator modules 105 projected from the support flange 101.

When the heating roller 100 is replaced, an operator unfastens the wing screw 106 and extracts the heating roller 100 from the frame 102 together with the support flange 101 or the like by holding the grip 111 with one hand as shown in FIG. 2. In order to prevent the heating roller 100 from contacting the frame 102 when the heating roller 100 passes through the opening part of the frame 102, felt is attached to the outer periphery of the opening part of the frame 102. Thus, scratches on the heating roller 100 are prevented.

The heating roller for use in the fixing unit of this type is a cylinder having a diameter of about 100 mm and a length of 500 mm or larger, which is very heavy in weight. Under such a circumstance, when an operator extracts the heating roller 100 from the frame 102 together with the support flange 101 or the like by holding the grip 111 with one hand and supporting the heating roller 100 with the other hand wearing a glove 120, an extracting operation becomes unstable due to the weight and heat of the heating roller 100 or the like. Therefore, during the replacement of the heating roller 100, there is a likelihood of causing the heating roller 100 to be brought into contact with other components such as the frame 102 to damage the front surface of the heating roller 100.

As described above, since the posture of the heating roller 100 becomes unstable and no auxiliary tool is provided for stabilizing the posture of the heating roller 100, an operator puts one hand wearing the glove 120 on the heating roller 100 when replacing the heating roller 100 in an embodiment disclosed in Patent Document 1. However, when an operator touches the heating roller 100 at high temperature, he or she gets burned or gets the glove 120 or the like soiled by a releasing agent and lubricant oil attached on the heating roller 100, which results in problems in operations.

Furthermore, when an operator extracts the heating roller 100 from the frame 102 together with the support flange 101 or the like by holding the grip 111 with one hand, there is a likelihood of causing the heating roller 100 to be brought into contact with the frame 102 to damage the front surface of the roller. Therefore, the vicinity of the opening of the frame 102 is coated with felt so as to be protected. However, when the heating roller 100 having a releasing agent and lubricant oil attached on its front surface is slid, a stain accumulates on the felt. Therefore, the above configuration is insufficient for protecting the front surface of the heating roller 100.

Furthermore, the felt is required to be attached and separated every time the heating roller 100 is replaced, which results in complicated replacement operations. Moreover, the felt is stained every time the heating roller 100 is replaced, which in turn requires the disposal of the stained felt and the preparation of new felt.

Patent Document 1: Japanese Patent Application National Laid-Open Publication No. 5-504633

SUMMARY OF THE INVENTION

The present invention may have an object of solving the deficiencies of the conventional technique and providing a roller replacement auxiliary tool of a fixing unit for easily and safely replacing a roller.

According to an embodiment of the present invention, there is provided a roller replacement auxiliary tool of a fixing unit for extracting at least one of a heating roller and a pressure roller from a replacement opening part formed in a frame of the fixing unit in a shaft direction so as to be replaced. The heating roller has a heater lamp provided therein, and the pressure roller is capable of being brought into press-contact with the heating roller. The roller replacement auxiliary tool includes a protection unit that protects the roller when the roller is replaced.

Other objects, features and advantages of the present invention will become more apparent from the following detailed description when read in conjunction with the accompanying drawings.

BRIEF DESCRIPTION OF THE DRAWINGS

FIGS. 9A and 9B are cross-sectional views of the assist unit, wherein FIG. 9A is a view where lever parts of two latches are mutually directed outward, and FIG. 9B is a view showing where the lever parts are mutually directed inward;

FIGS. 11A through 11F are views showing a support roller member used in the embodiment of the present invention, wherein FIGS. 11A and 11B are, respectively, a side view and a plan view when the support roller member is at an operating position, FIGS. 11C and 11D are, respectively, a side view and a plan view when the support roller member is being moved from the operating position to a standby position, and FIGS. 11E and 11F are, respectively, a side view and a plan view when the support roller member is at the standby position;

FIGS. 15A and 15B are cross-sectional views showing a relationship between an absorber and holding pieces of a holder taken along the plane X-X in FIG. 16, wherein FIG. 15A is a view where the assist unit is inserted in the heating roller, and FIG. 15B is a view immediately before the assist unit is attached to the absorber;

DETAILED DESCRIPTION OF THE PREFERRED EMBODIMENTS

Referring to the accompanying drawings, an embodiment of the present invention is described in detail below.

(Entire Configuration of Laser Beam Printer)

Figure 1:
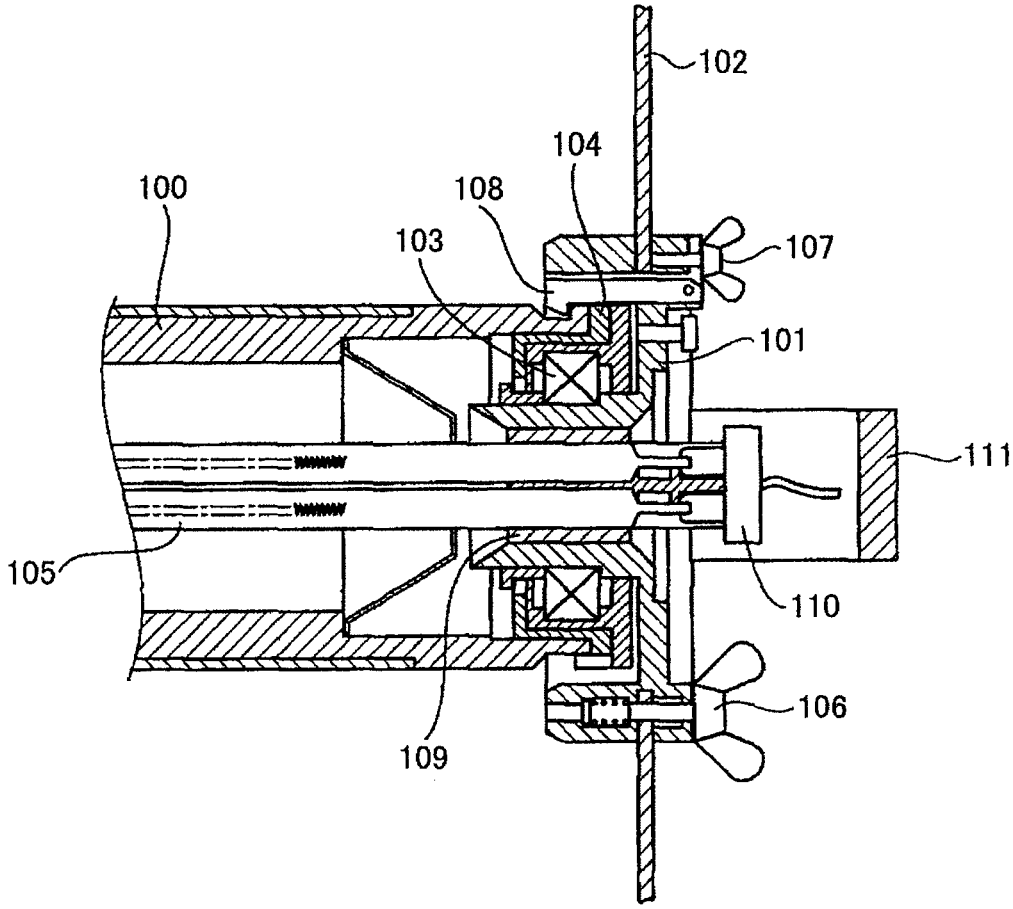
FIG. 1 is a partial cross-sectional view of a conventional fixing unit.
Figure 2:
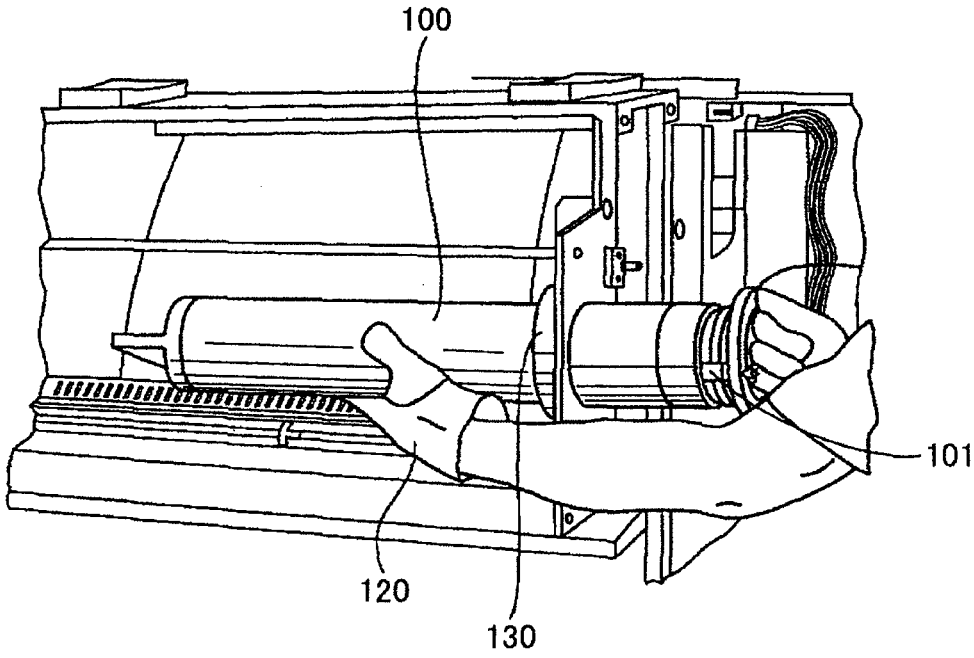
FIG. 2 is a perspective view showing the heating roller of a fixing unit being replaced.
Figure 3:
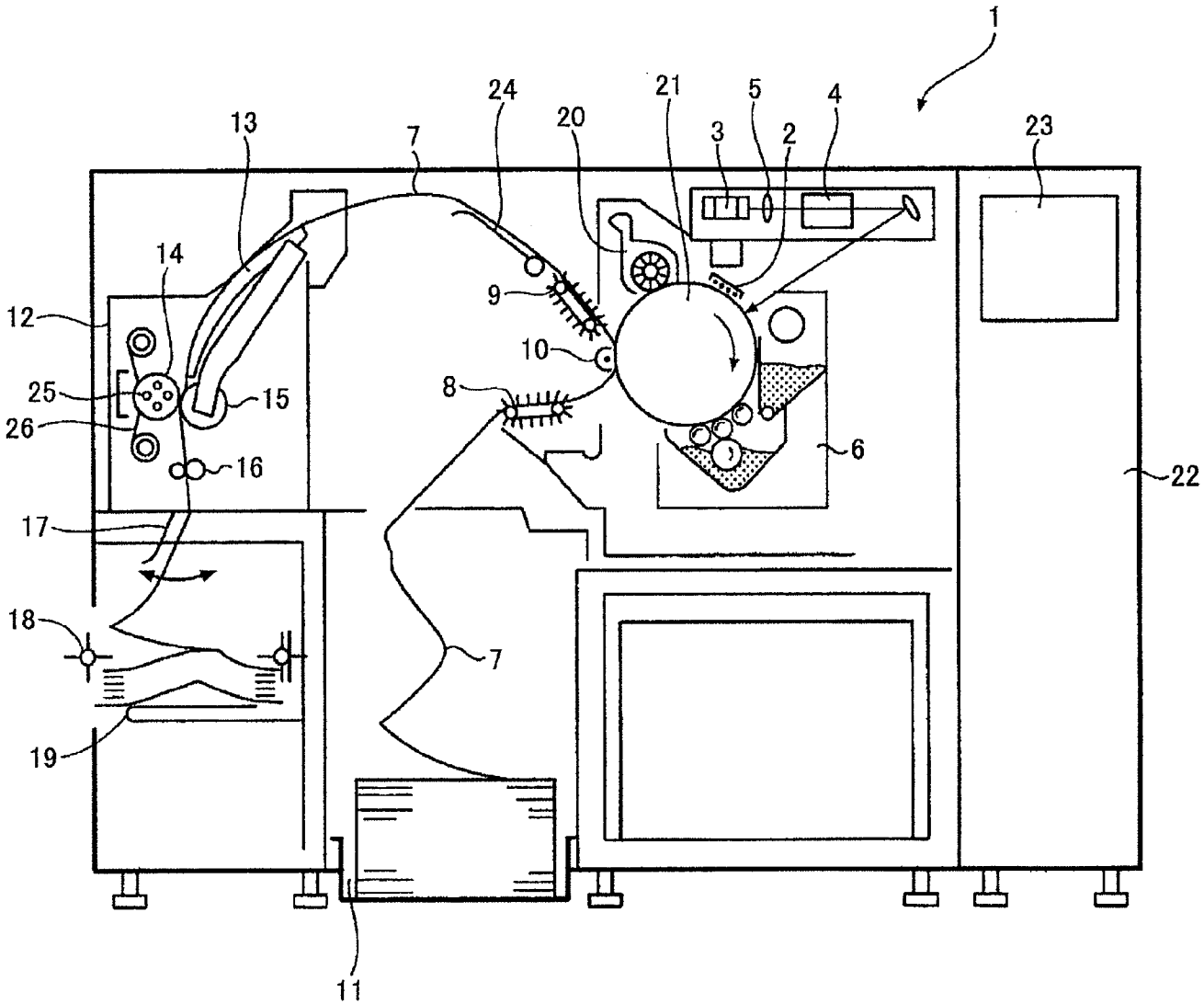
FIG. 3 is a schematic view of a laser beam printer according to an embodiment of the present invention.

Referring first to FIG. 3, a description is made of the entire configuration of an electro-photographic laser beam printer to which the embodiment of the present invention is applied.

In FIG. 3, reference numeral 1 denotes a laser beam printer, and a photosensitive drum 21 rotates in the direction as indicated by the arrow in accordance with a print-operation start signal from a controller 22. The photosensitive drum 21 rotates at a speed equivalent to the print speed of the laser beam printer 1 and continues its rotation until a print operation stops. When the photosensitive drum 21 starts its rotation, a high voltage is applied to a corona charger 2. Then, the corona charger 2 uniformly charges, for example, positive charges on the front surface of the photosensitive drum 21.

When power is supplied to the laser beam printer 1, a rotary polygon mirror 3 immediately starts its rotation. The rotary polygon mirror 3 maintains a constant-speed rotation with high accuracy while power is supplied to the laser beam printer 1. Light output from a light source 4 such as a semiconductor laser is reflected by the rotary polygon mirror 3 and irradiated on the photosensitive drum 21 through an f-θ lens 5 in a scanning manner. When text data and graphic data converted into dot images are supplied from the controller 22 to the laser beam printer 1 as on/off signals of a laser beam, some part of the front surface of the photosensitive drum 21 is irradiated with the laser beam but another part of the front surface of the photosensitive drum 21 is not irradiated. At this time, an electrostatic latent image is formed on the front surface of the photosensitive drum 21.

When the region of the photosensitive drum 21 maintaining the electrostatic latent image reaches a position opposite to a development unit 6, toner is supplied to the electrostatic latent image. For example, the positively-charged toner is attracted by static electricity to a part on the photosensitive drum 21 where the charges are caused to disappear due to the irradiation of the laser beam, which in turn forms a toner image on the photosensitive drum 21.

A sheet conveyance tractor 8 conveys a continuous sheet (medium to be recorded) 7 accommodated in a sheet hopper 11 to a place between the photosensitive drum 21 and a transfer unit 10 in synchronization with a timing at which the toner image formed on the photosensitive drum 21 reaches a transfer position. The toner image formed on the photosensitive drum 21 is attracted onto the sheet 7 by the operation of the transfer unit 10 that applies charges having a polarity opposite to that of the toner image to the rear surface of the sheet 7.

Then, the sheet 7 is conveyed to a fixing unit 12 via the sheet conveyance tractor 8, the transfer unit 10, a sheet conveyance tractor 9, and a buffer plate 24. After reaching the fixing unit 12, the sheet 7 is preheated by a pre-heater 13 incorporating plural heaters and held and conveyed so as to be heated and pressed by a nip part having a pair of fixing rollers composed of a heating roller 14 and a pressure roller 15 incorporating plural heater lamps 25. In this manner, the toner image is melted and fixed to the sheet 7.

The sheet 7 fed from the heating roller 14 and the pressure roller 15 is fed to a stacker table 19 by a sheet feeding roller 16 while being alternately folded along perforations by the swing operation of a swing fin 17. Moreover, the sheet 7 is stacked on the stacker table 19 so as to be accurately folded by a rotating paddle 18. The region of the photosensitive drum 21 having passed through the transfer position is cleaned by a cleaning unit 20 and on standby for a next print operation.

The buffer plate 24 is used for absorbing the slack or tension caused in the sheet 7 when there is a difference in a sheet conveyance speed between the sheet conveyance tractor 9 and the fixing rollers (the heating roller 14 and the pressure roller 15). Reference numeral 23 is a display screen for displaying information based on the status of the laser beam printer 1 during the print operation. Reference numeral 26 is a web member capable of contacting the front surface of the heating roller 14 and being wound up from the front surface of the heating roller 14, which is used for coating a releasing agent and lubricant oil on the front surface of the heating roller 14.

(Structure near Heating Roller)

Figure 4:
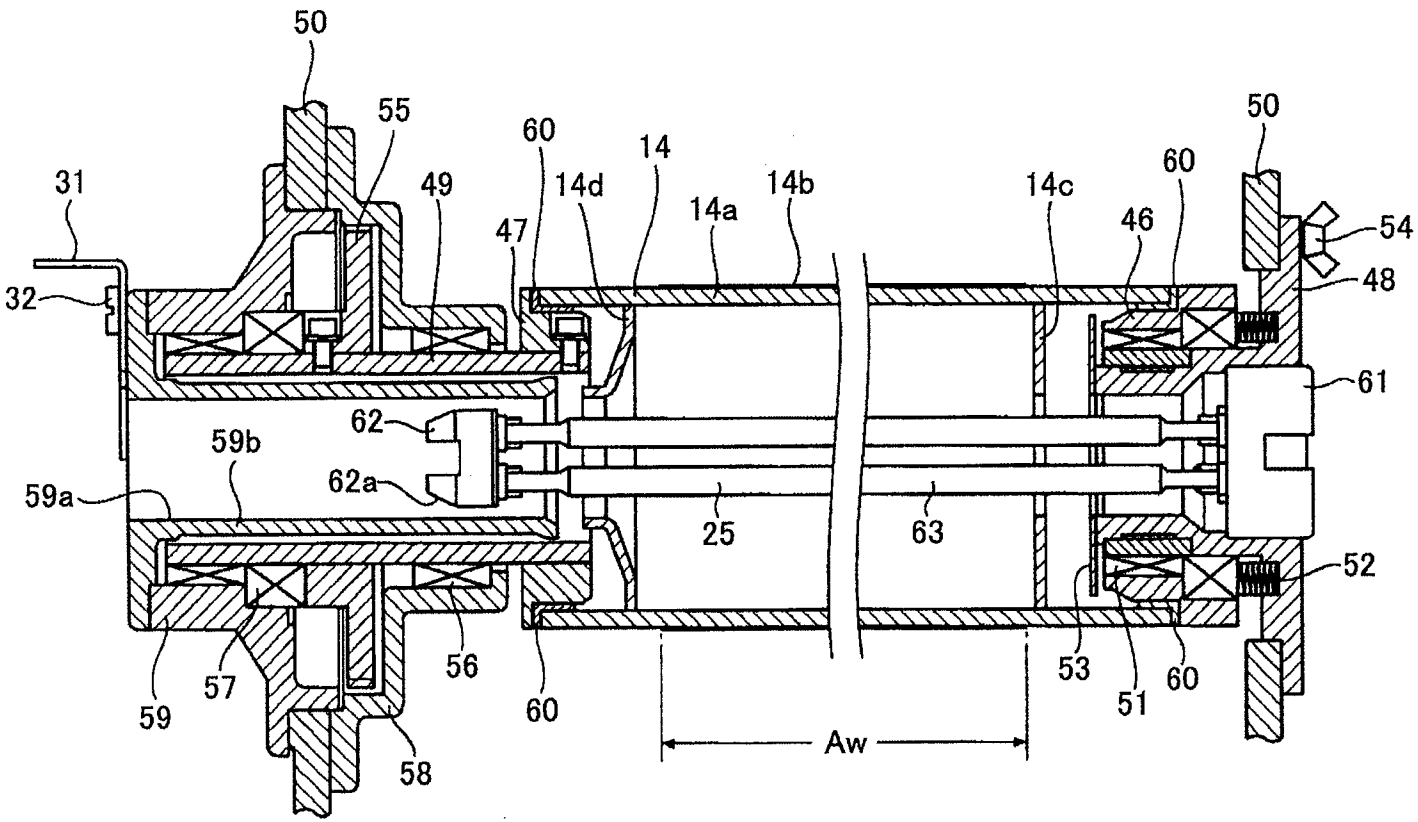
FIG. 4 is a cross-sectional view near a heating roller according to the embodiment of the present invention.

Referring next to FIG. 4, a description is made of a structure near the heating roller 14 of the fixing unit 12.

The heating roller 14 is composed of a metal pipe 14*a* made of, for example, aluminum and a front surface layer 14*b* provided on a sheet passage region Aw of the peripheral surface of the pipe 14*a*. The front surface layer 14*b* is composed of a film such as a PFA (tetrafluoroethylene-perfluoroalkyl vinyl ether copolymer) resin, a silicon rubber layer, and a PFA tube covering the silicon rubber layer and a part above the silicon rubber layer.

Inside areas near openings at the both ends of the heating roller 14, substantially disc-like heating roller lids (hereinafter referred to as absorbers) 14*c* and 14*d* made of, for example, aluminum are fixed one at each end. The absorbers 14*c* and 14*d* prevent a temperature at the front surface of the heating roller 14 from fluctuating and the temperature of an apparatus from rising due to the transfer of heat from the plural heater lamps 25 incorporated in the heating roller 14 to the outside of the heating roller 14.

As shown in FIG. 4, the absorbers 14*c* and 14*d* are provided at positions slightly outside of the sheet passage region Aw of the heating roller 14. Accordingly, an interval between the absorbers 14*c* and 14*d* is slightly greater than the length of the sheet passage region Aw in the shaft direction. Moreover, the length of each of the heater lamps 25 is slightly greater than the interval between the absorbers 14*c* and 14*d*.

If all or parts of the absorbers 14*c* and 14*d* are positioned inside the sheet passage region Aw of the heating roller 14, transmission of the heat from the heater lamps 25 is interfered with by the absorbers 14*c* and 14*d* and thus the temperature at the front surface of the heating roller 14 may not reach a desired temperature. In order to prevent this, the absorbers 14*c* and 14*d* are provided so as not to be positioned inside the sheet passage region Aw of the heating roller 14.

The ends of the heating roller 14 are supported by frames 50 of the fixing unit 12 through holding members 48 and 49 having centering members 46 and 47, respectively.

The holding member 48 is provided with the centering member 46 through a bearing 51, and the centering member 46 is inserted inside one of the opening ends of the heating roller 14. The bearing 51 can absorb the thermal expansion of the heating roller 14 and dimensional variations in peripheral support members with plural springs 52 provided in the peripheral direction of the bearing 51 and a stopper plate 53 arranged on an end surface inside the holding member 48.

When being assembled with the heating roller 14, the plural springs 52 are somewhat compressed to form a gap between the centering member 46 and the bearing 51, and the stopper plate 53 as shown in FIG. 4. The holding member 48 is fixed to one of the frames 50 by plural wing screws 54.

The holding member 49 is provided with a gear 55 for receiving a driving force from a motor (not shown) that rotates and drives the heating roller 14 and is rotatably supported by housings 58 and 59 through bearings 56 and 57, respectively.

At the other of the opening ends of the heating roller 14 opposing the centering member 47 of the heating roller 14, keyways (not shown) extending in the shaft direction are formed. At the end of the centering member 47, keys (not shown) fitting in the keyways are provided. The heating roller 14 and the centering member 47 are connected to each other through this key structure. Accordingly, the driving force of the motor is transmitted to the heating roller 47 through the gear 55, the holding member 49, the centering member 47, and the key structure, whereby the heating roller 14 is rotated in a predetermined direction.

Note that the shaft direction of the heating roller 14 is restricted by the holding member 48 positioned on a front side (that refers to the side of the frame 50 where the heating roller 14 is inserted and is also called an "operation side"). On the other hand, since the keys of the centering member 47 provided on a rear side are approximately the same in size as the widths of the keyways, the rotational direction of the heating roller 14 is restricted. Note that although the positions of the keys and the keyways are arbitrarily set, they are preferably set so as to be easily confirmed. In this embodiment, the keys and the keyways are shifted by 90° in a circumferential direction relative to a holder 43 of an assist unit 40 (see FIG. 9A).

Further, keyways are also provided on the front side besides the rear side, and the keyways are arranged with their phases shifted by 180° to each other. With this arrangement of the keyways, wobbling of the heating roller 14 is prevented. Note that although the keyways are provided one on each of the front side and the rear side in this embodiment, they may be provided, for example, two on each of them.

As described above, the keys and the keyways are provided so as to be shifted by 90° to each other relative to the assist unit 40. Therefore, when the assist unit 40 is connected to the absorber 14*c*, the keyways on the front side and the keyways on the rear side are automatically positioned.

In order to prevent damage and the transfer of heat from the heating roller 14 to the centering members 46 and 47, rings 60 made of a heat-resistant synthetic resin are interposed between the corresponding ends of the heating roller 14 and the centering members 46 and 47. Note that in the ring 60 on the side of the centering member 47, groove-like notches (not shown) are formed at a position corresponding to the keyways of the heating roller 14 and allow for fitting between the keys and the keyways.

The heater lamps 25 serving as the heat sources of the heating roller 14 constitute a lamp cartridge 63 bundled by lamp holders 61 and 62 that hold the corresponding ends of the heater lamps 25. The lamp cartridge 63 is provided at the center inside the heating roller 14 as shown in FIG. 4.

(Detachment and Attachment of Lamp Cartridge)

Figure 5:
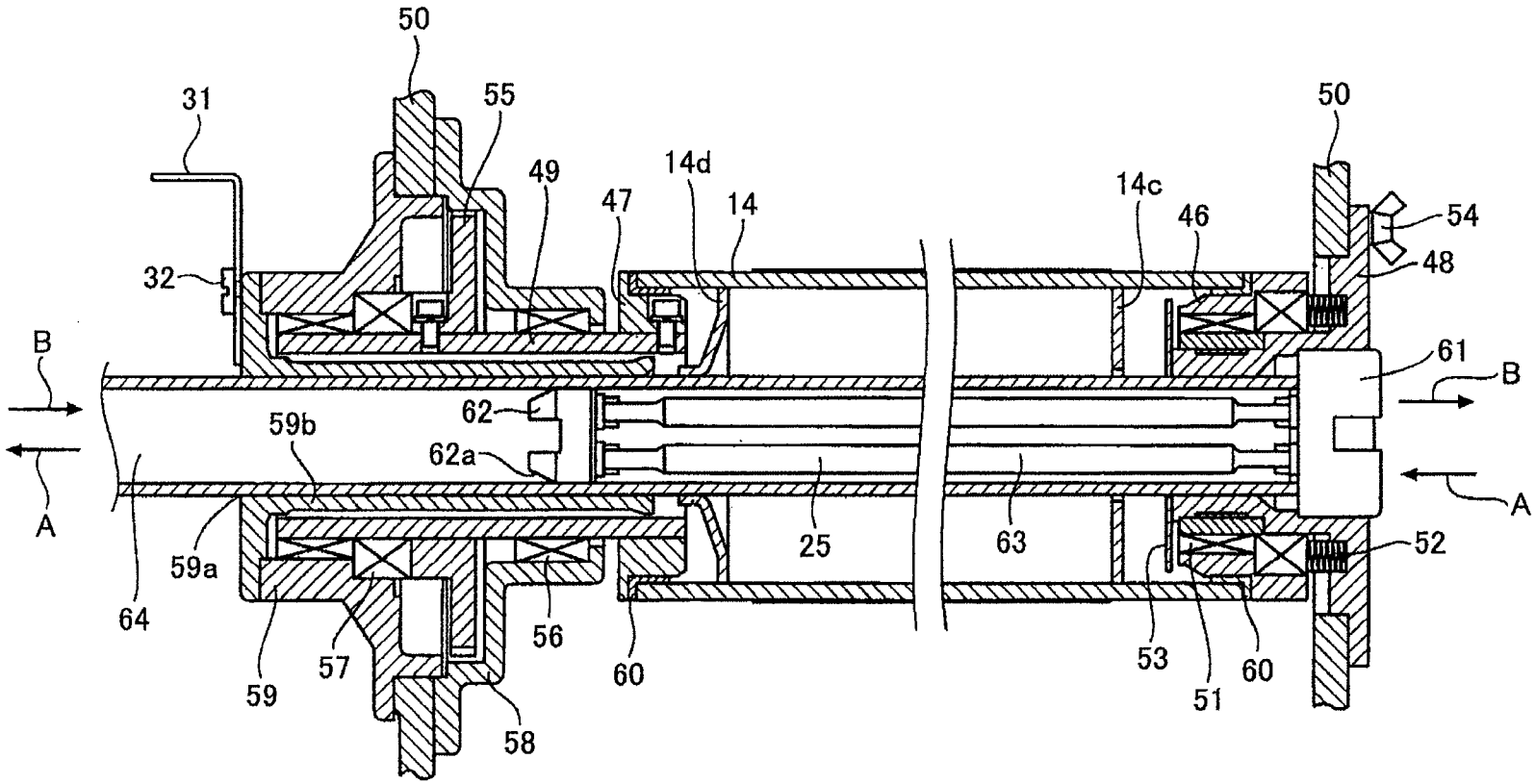
FIG. 5 is a cross-sectional view where a lamp protection member is attached to the heating roller in the embodiment of the present invention.

Referring next to FIG. 5, a description is made of the detachment and attachment of the lamp cartridge 63.

When the lamp cartridge 63 or the heating roller 14 described below is being replaced, a lamp protection member 64 made of, for example, a paper cylinder is used as shown in FIG. 5. The outer diameter of the lamp protection member 64 is approximately the same in size as the inner diameter of the holding member 48 and the inner diameter of an inner cylinder 59*b* of the housing 59. Furthermore, the inner diameter of the lamp protection member 64 is approximately the same in size as the outer diameter of the lamp holder 62. Furthermore, the length of the lamp protection member 64 is slightly greater than the distance between the left and right frames 50.

The lamp cartridge 63 is inserted in the heating roller 14 from the side of the lamp holder 62, and the right end of the lamp protection member 64 is brought into contact with the end surface of the other lamp holder 61 as shown in FIG. 5. The tip end part of the lamp holder 62 has an inclination 62*a* for facilitating the insertion of the lamp cartridge 63 in the lamp protection member 64.

The lamp cartridge 63 thus covered with the lamp protection member 64 is inserted from the side of the holding member 48 as indicated by arrow A in FIG. 5, while the lamp protection member 64 is guided by the holding member 48 and the inner cylinder 59*b* of the housing 59. The insertion of the lamp cartridge 63 is stopped when a part of the lamp holder 61 is brought into contact with the holding member 48.

At this time, the tip end part of the lamp protection member 64 in the inserting direction projects from the housing 59 to an outside of the apparatus. Therefore, when the rest of the lamp protection member 64 is extracted in the direction as indicated by the arrow A following the projecting part of the tip end part, the attachment of the lamp cartridge 63 is completed.

When the lamp cartridge 63 is extracted from the heating roller 14, the lamp protection member 64 is inserted from the side of the through-hole 59*a* of the housing 59 as indicated by arrow B in FIG. 5. At this time, the tip end part of the lamp protection member 64 in the inserting direction is brought into contact with the end surface of the lamp holder 61 while being guided by the inner cylinder 59*b* of the housing 59, the inclination 62*a* of the lamp holder 62, and the holding member 48. Accordingly, the lamp holder 62 is accommodated in the lamp protection member 64. When the lamp protection member 64 is further inserted, the lamp cartridge 63 is pushed in the direction as indicated by the arrow B together with the lamp protection member 64, which in turn makes it possible to extract the lamp cartridge 63.

As described above, the insertion and the extraction of the lamp cartridge 63 covered with the lamp protection member 64 can prevent damage to the plural lamps 25 during the handling of the lamp cartridge 63. The paper cylinder is preferred as the lamp protection member 64 because it has thermal insulating properties, predetermined mechanical strength, and is easily obtained due to its low cost.

(Configuration of Auxiliary Tool for Replacing Heating Roller)

Next, a description is made of an auxiliary tool for replacing the heating roller 14. The auxiliary tool according to this embodiment is composed of a roller insertion-and-extraction guide shaft 30, an assist unit 40, and a support roller member 70.

Figure 6:
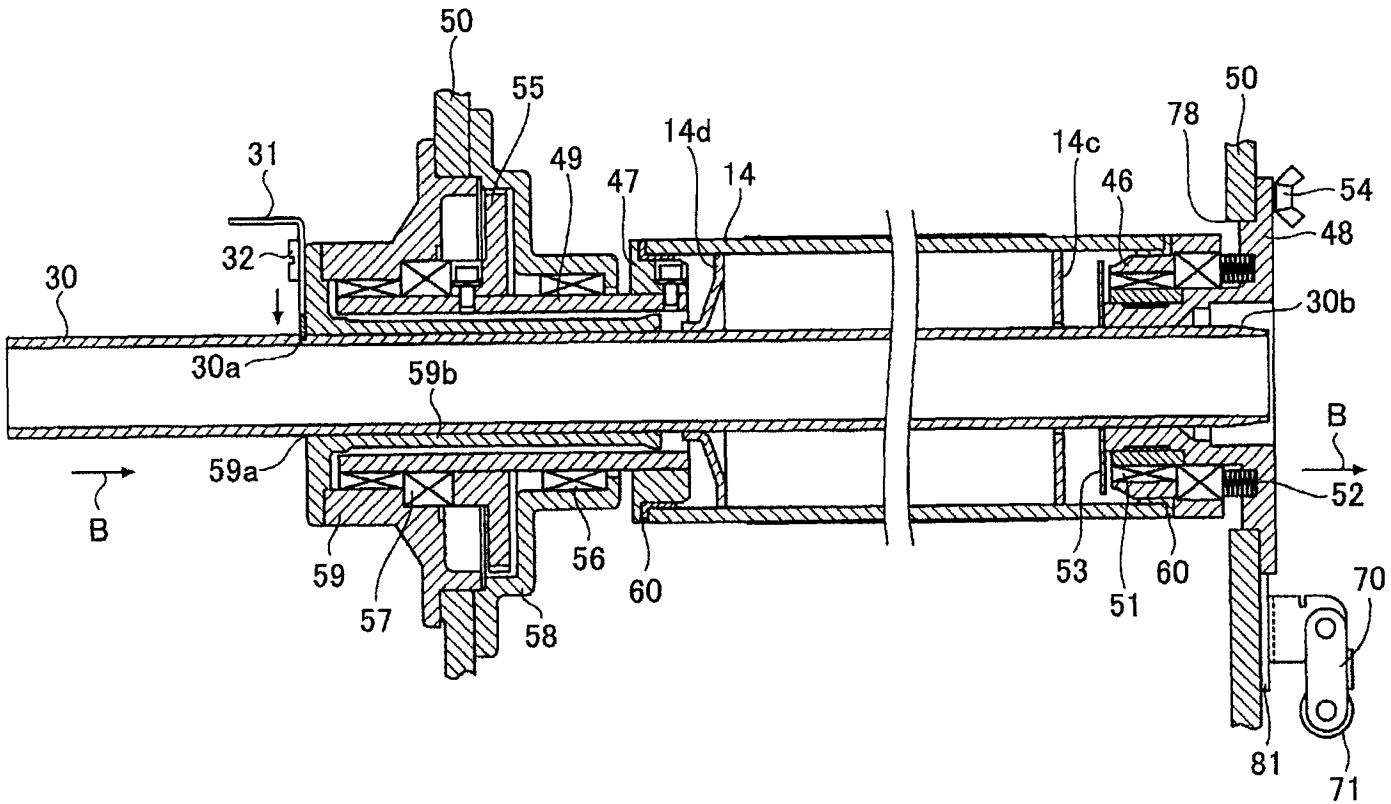
FIG. 6 is a cross-sectional view where a roller insertion-and-extraction guide shaft is attached to the inside of the heating roller in the embodiment of the present invention.

The roller insertion-and-extraction guide shaft 30 is a cylindrical body having rigidity made of metal or a hard synthetic resin. As shown in FIG. 6, the length of the roller insertion-and-extraction guide shaft 30 is slightly greater than the distance between the left and right frames 50, and the outer diameter of the roller insertion-and-extraction guide shaft 30 is approximately the same in size as the inner diameter of the holding member 48, the inner diameter of the absorber 14*d*, and the inner diameter of the inner cylinder 59*b* of the housing 59. At the rear end part of the roller insertion-and-extraction guide shaft 30 in the inserting direction, engagement grooves 30*a* are formed along the circumferential direction.

On the side surface of the housing 59, a plate-like stopper 31 for fixing (locking) the roller insertion-and-extraction guide shaft 30 is slidably held by a pin 32. As shown in FIG. 6, the engagement grooves 30*a* are provided in the peripheral wall of the roller insertion-and-extraction guide shaft 30 such that the stopper 31 is fitted in the roller insertion-and-extraction guide shaft 30 when the roller insertion-and-extraction guide shaft 30 is inserted into a predetermined position.

Fixing (Locking) the roller insertion-and-extraction guide shaft 30 to a predetermined position as described above makes it possible to smoothly perform the inserting and extracting operation of the foregoing respective members without causing a positional shift of the roller insertion-and-extraction guide shaft 30 in the shaft direction when the heating roller 14, the holding member 48, and the assist unit 40 are inserted and extracted.

At the outer periphery of the tip end part of the roller insertion-and-extraction guide shaft 30 in the inserting direction, an inclination surface 30*b* for smoothing the insertion of the assist unit 40 or the like is formed. When the roller insertion-and-extraction guide shaft 30 is fixed to a predetermined position, the tip end part (inclination surface 30*b*) of the roller insertion-and-extraction guide shaft 30 in the inserting direction slightly projects outward from the side surface of the frame 50 (see FIG. 7).

Figure 8:
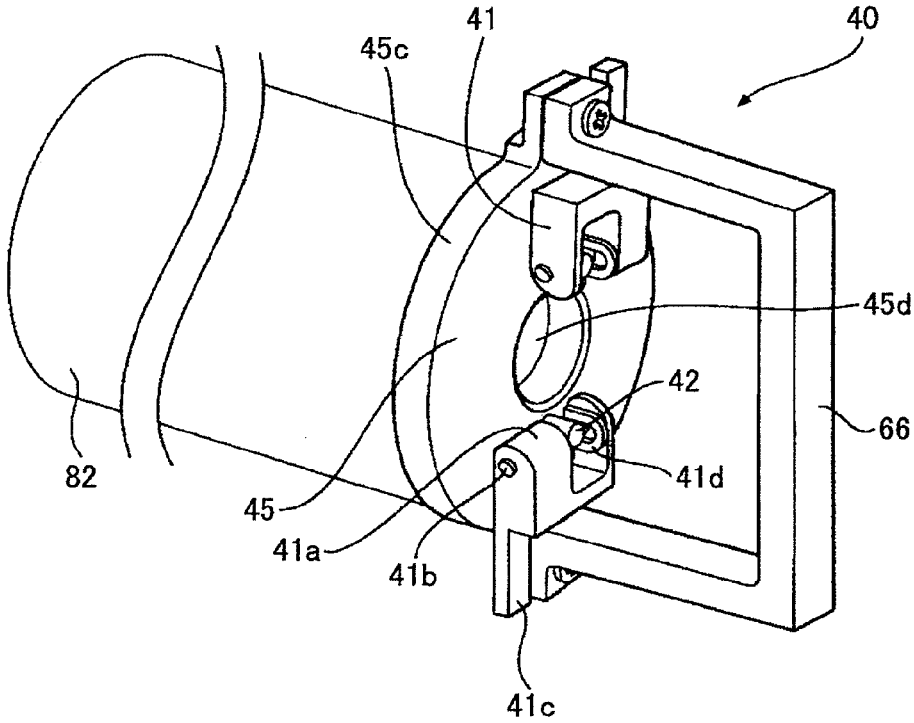
FIG. 8 is a perspective view of an assist unit used in the embodiment of the present invention.
Figure 9A:
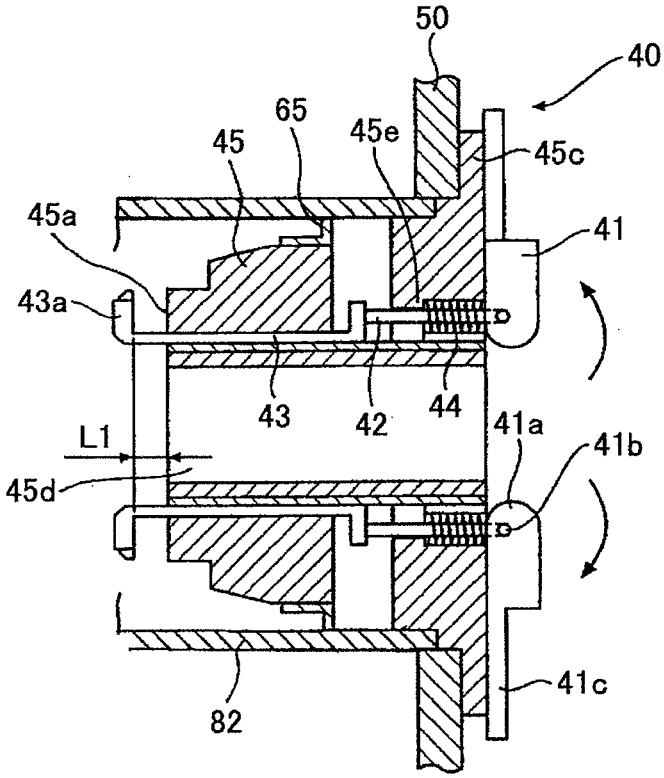
Figure 9B:
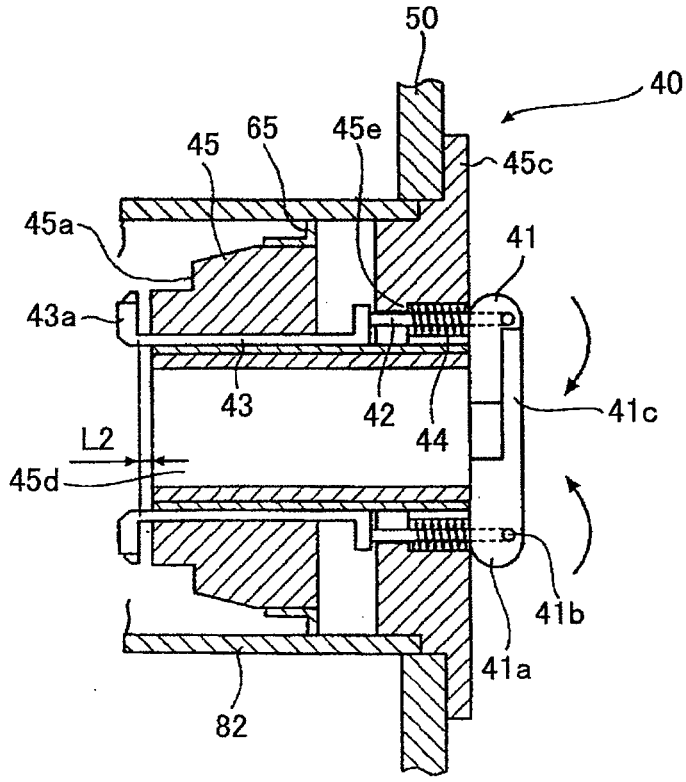

As shown in FIG. 8 and FIGS. 9A and 9B, the assist unit 40 is composed of an assist unit main body 45; two latches 41 rotatably attached to the side surface of the assist unit main body 45; shafts 42 that transmit the movements of the two latches 41 to a holder 43; the holder 43 (see FIGS. 9A and 9B) that has one end linked to the shafts 42 and the other end folded toward an outside; coil-like springs 44 that absorb component tolerances to reliably fix the heating roller 14; a handle 66 attached on the side surface of the assist unit main body 45, and a protection member 82.

Figure 17:
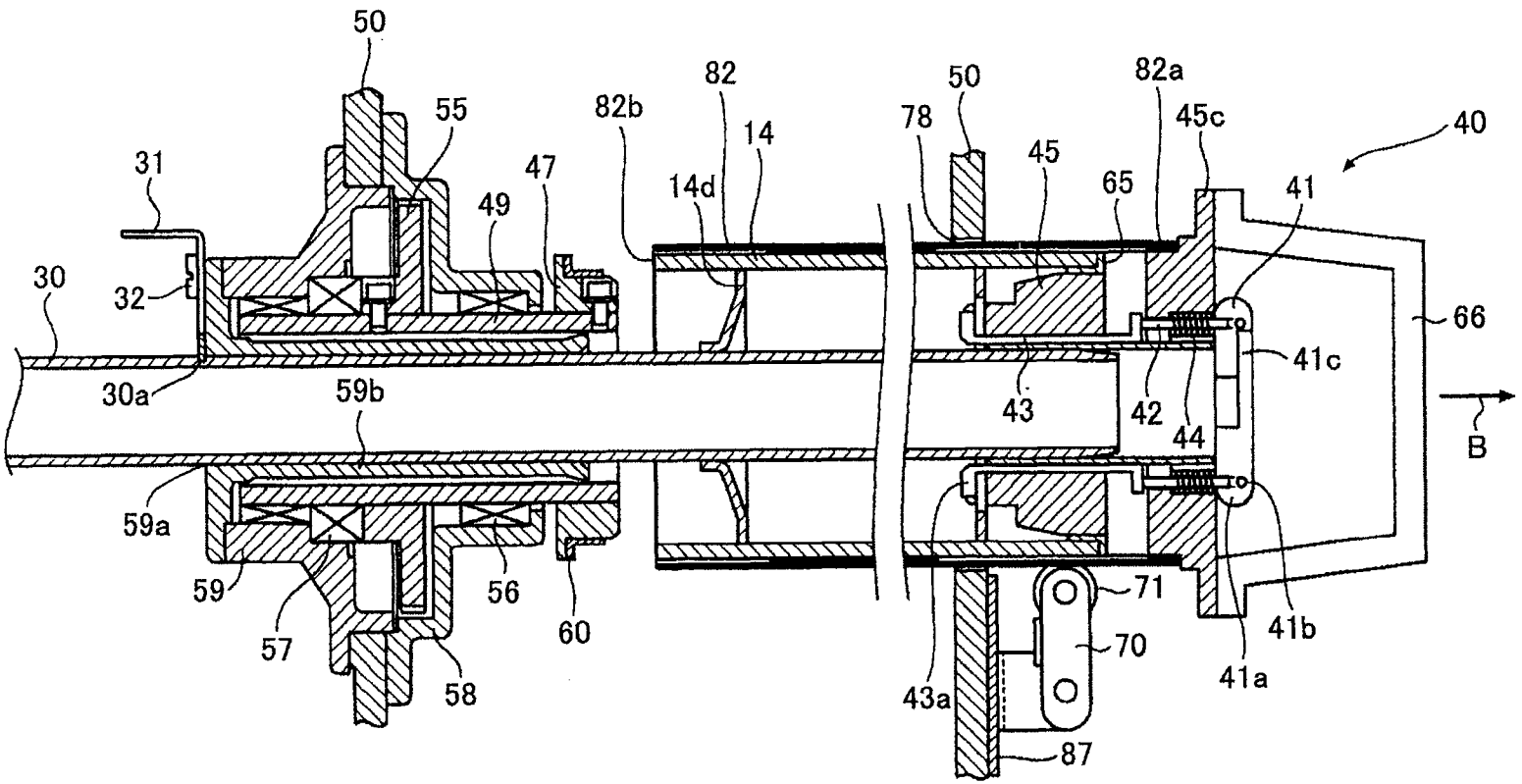
FIG. 17 is a cross-sectional view of the heating roller being extracted in the embodiment of the present invention.

An insertion hole 45*d* penetrating along a shaft direction is provided at the center of the assist unit main body 45. A flange 45*c* is formed at one side surface of the assist unit main body 45. As shown in FIG. 17, a ring 65 is provided at a position that the opening end of the heating roller 14 contacts when the heating roller 14 is being replaced. The inner diameter of the inserting hole 45*d* is approximately the same in size as the outer diameter of the roller insertion-and-extraction guide shaft 30.

The two latches 41 are identical in shape. Each of the two latches 41 has a semi-cylindrical-like rotary part 41*a* which is formed at one end and whose side surface is shaped like a semicircle; a shaft part 41*b* provided inside the rotary part 41*a* so as to be off-center in the thickness direction of the rotary part 41*a*; and the lever part 41*c* provided opposite to the rotary part 41*a*. The two latches 41 are attached to the assist unit main body 45 such that the rotary parts 41*a* are opposite to each other across the inserting hole 45*d*.

As shown in FIGS. 9A and 9B, first ends of the shafts 42 are linked to the corresponding shaft parts 41*b* of the latches 41. Furthermore, at the other end of the holder 43 opposite to the end linked to the shafts 42, holding pieces 43*a* are folded so as to be opposite to face an inner side surface 45*a* of the assist unit main body 45.

The coil-like springs 44 are interposed between a step-like spring receiving part 45*e* provided in the assist unit main body 45 and the latches 41. The shafts 42 are inserted inside the springs 44, and the latches 41 are elastically biased to an outer direction at all times by the elastic force of the springs 44. However, each of the latches 41 has a locking unit 41*d* as shown in FIG. 8.

FIG. 9A shows where the lever parts 41*c* of the two latches 41 are mutually directed outward. At this time, the shaft parts 41*b* of the latches 41 are positioned close to the assist unit main body 45. Therefore, an interval between the holding pieces 43*a* of the holder 43 and the inner side surface 45*a* of the assist unit main body 45 becomes large as indicated by L1. The interval L1 is slightly greater than the thickness of the absorber 14*c*. FIG. 8 also shows where the lever parts 41*c* of the two latches 41 are mutually directed outward as in the case of FIG. 9A.

As shown in FIG. 9B, when the lever parts 41*c* of the two latches 41 are mutually rotated inward, the shaft parts 41*b* of the latches 41 are moved in a direction away from the assist unit main body 45. Along with the off-centering of the latches 41, the shafts 42 and the holder 43 are also moved, which in turn reduces the interval between the holding pieces 43*a* of the holder 43 and the inner side surface 45*a* of the assist unit main body 45 as indicated by L2. The interval L2 is slightly less than the thickness of the absorber 14*c*.

As shown in FIG. 8, the protection member 82 is shaped like a complete cylinder and has mechanical strength sufficient for maintaining its cylindrical shape. As shown in FIG. 17, one opening end 82*a* of the protection member 82 is fixed or detachably attached to the peripheral surface of the assist unit main body 45, and the other opening end 82*b* of the protection member 82 is open. The inner diameter of the protection member 82 is slightly larger than the outer diameter of the heating roller 14. When the heating roller 14 is covered with the protection member 82, a small gap G is formed between the heating roller 14 and the protection member 82 as shown in FIG. 10, with the result that the protection member 82 does not directly contact the heating roller 14.

Figure 10:
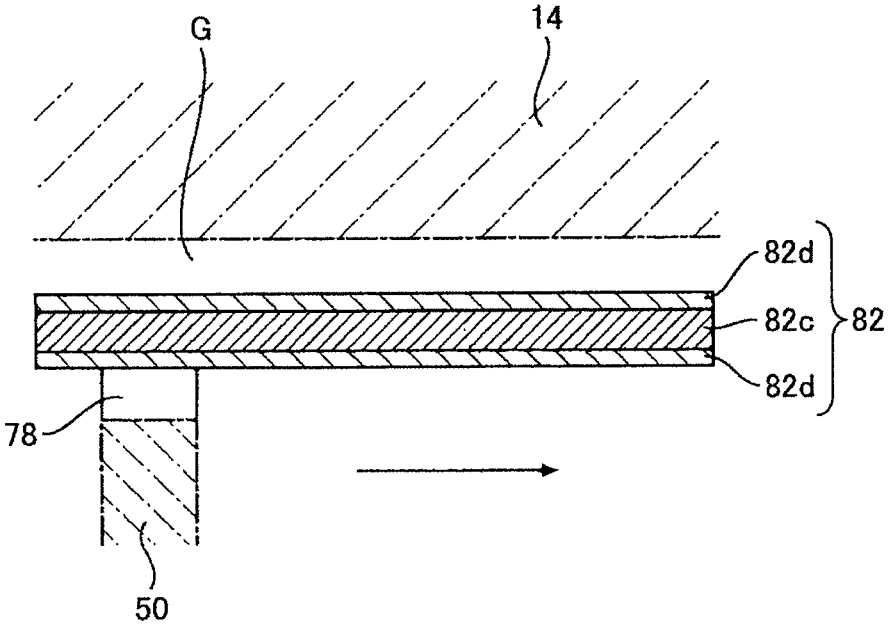
FIG. 10 is an enlarged cross-sectional view of a protection member in the embodiment of the present invention.

FIG. 10 is a partially enlarged cross-sectional view of the protection member 82. As shown in FIG. 10, the protection member 82 is composed of a base substance 82*c* and heat insulation layers 82*d* provided at the inner and outer peripheral surfaces of the base substance 82*c*. The base substance 82*c* is made of metal such as aluminum or a heat-resistant resin such as a polyamide resin, a polyamideimide resin, a polyphenylene oxide resin, a polysulphone resin, and a fluorine resin. Various heat-resistant materials are available as the heat insulating layers 82*d*, but flexible materials such as non-woven fabric and hair implanted bodies are applied in consideration of protecting the front surface of the heating roller 14.

As shown in FIGS. 11A through 11F, a support roller member 70 is mainly composed of a support roller 71; a first shaft 72 that rotatably supports the support roller 71; a roller plate 73 that fixes the first shaft 72 to one free end; a second shaft 74 provided at the base end of the roller plate 73; and a holder plate 75 that rotatably supports the second shaft 74.

One side end of the roller plate 73 is folded to form a hook 76 in an integrated manner, and a groove part 77 (see FIG. 11E) is formed in the holder plate 75 for fitting with (engagement with) the hook 76. The width of the groove part 77 is approximately the same in size as the plate thickness of the hook 76. Further, an elongated hole 75*a*, which extends parallel to the groove part 77 and in which the second shaft 74 is inserted, is formed in the holder plate 75. As described below, the roller plate 73 is supported in a manner capable of being vertically moved.

Figure 11A:
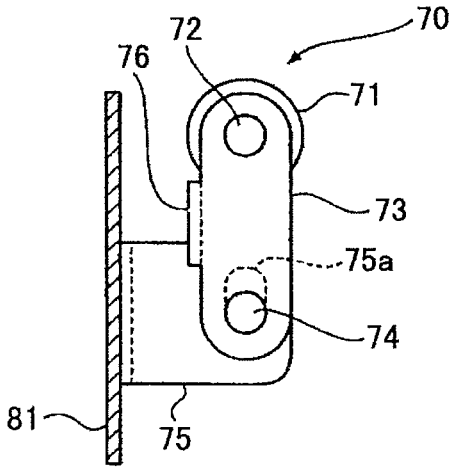
Figure 11B:
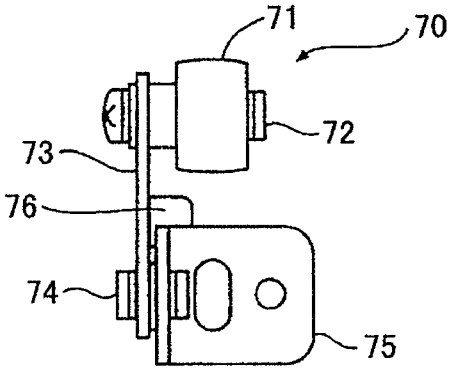

FIGS. 11A and 11B are diagrams showing the support roller member 70 when the heating roller 14 is extracted from or inserted in the image forming apparatus. FIG. 11A is a side view of the support roller member 70, and the FIG. 11B is an end plan view. As shown in FIG. 11A, when the hook 76 provided in the roller plate 73 is inserted in (locked by) the groove part 77 formed in the holder plate 75, the roller plate 73 is maintained upright. Accordingly, as shown in FIG. 17, the support roller 71 faces an opening part 78 of the frame 50 for replacement purposes.

Figure 11C:
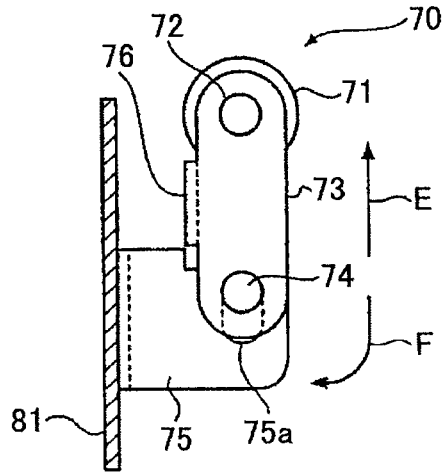
Figure 11D:
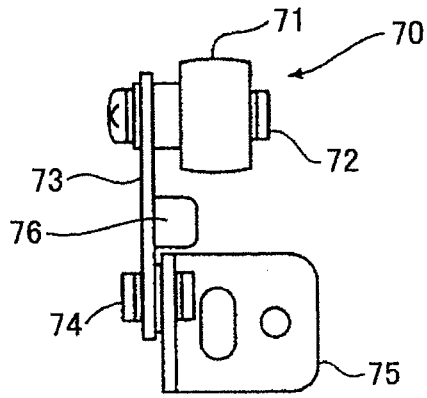

FIGS. 11C and 11D are diagrams showing when the support roller member 70 is being moved from the operating position described above to a standby position described below. FIG. 11C is a side view of the support roller member 70, and the FIG. 11D is an end plan view. As shown in FIG. 11C, the roller plate 73 is lifted up in the direction as indicated by arrow E to disengage (unlock) the hook 76 from the groove part 77. Then, the roller plate 73 is rotated 180 degrees about the center of the second shaft 74 in the direction as indicated by arrow F.

Figure 11E:
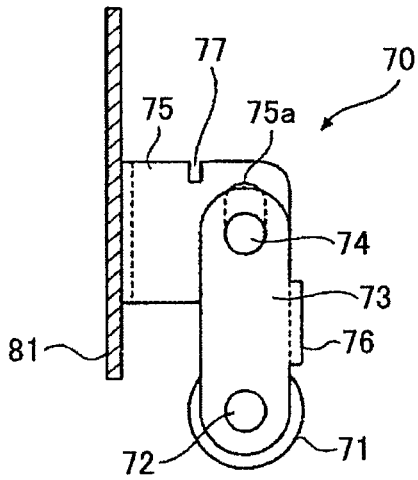
Figure 11F:
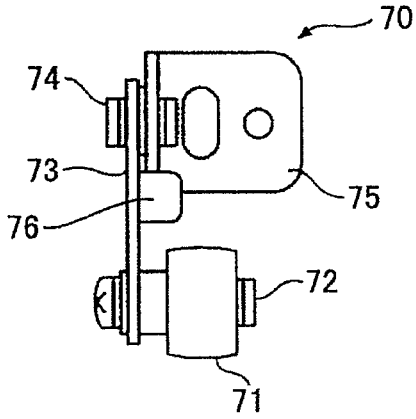

FIGS. 11E and 11F are diagrams showing when the support roller member 70 is on standby. FIG. 11E is a side view of the support roller member 70 and FIG. 11F is an end plan view where the roller plate 73 is suspended from the second shaft 74. Accordingly, the support roller 71 is on standby at a lower position away from the opening part 78 of the frame 50 (see FIG. 6) for replacement purposes.

Figure 12:
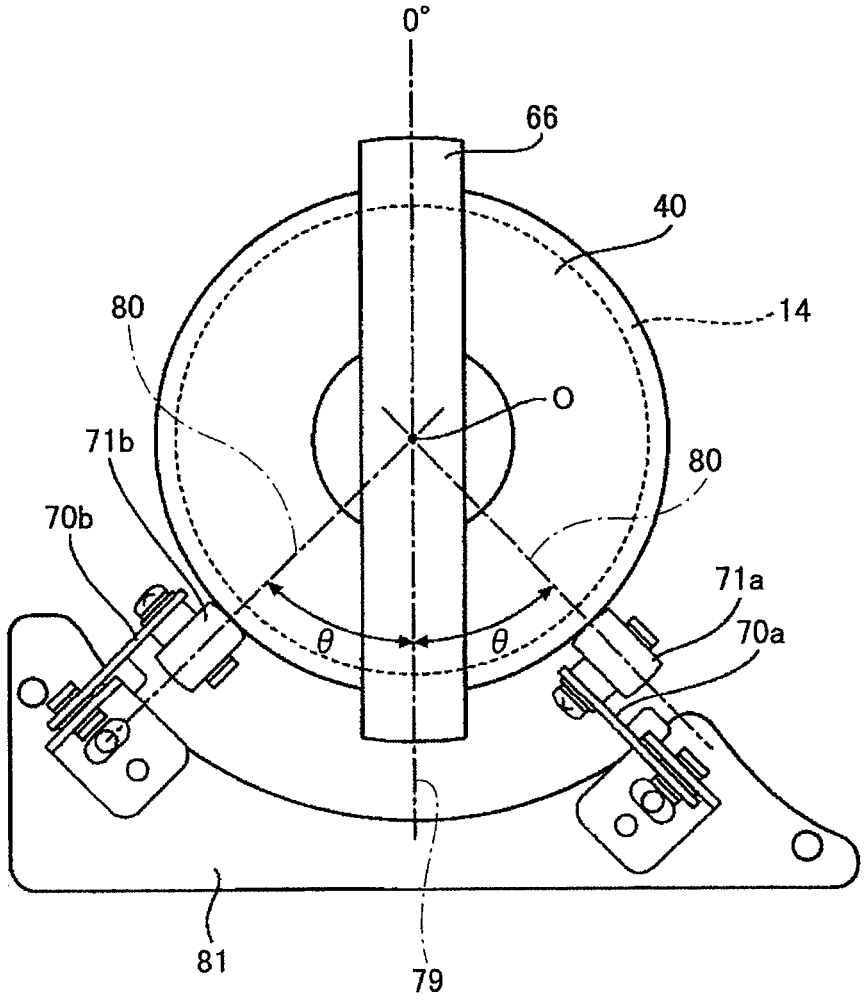
FIG. 12 is a view showing the arrangement of two assist roller members with respect to the assist unit in the embodiment of the present invention.

FIG. 12 is a diagram showing the arrangement of the support roller members 70 with respect to the assist unit 40. According to this embodiment, two assist roller members 70*a* and 70*b* are used. The two assist roller members 70*a* and 70*b* are provided on the outer side surface of the frame 50 and near the opening part 78 of the frame 50 for replacement purposes such that the heating roller 14 can be smoothly extracted with the handle 66 of the assist unit 40 being gripped by hand.

Figure 13:
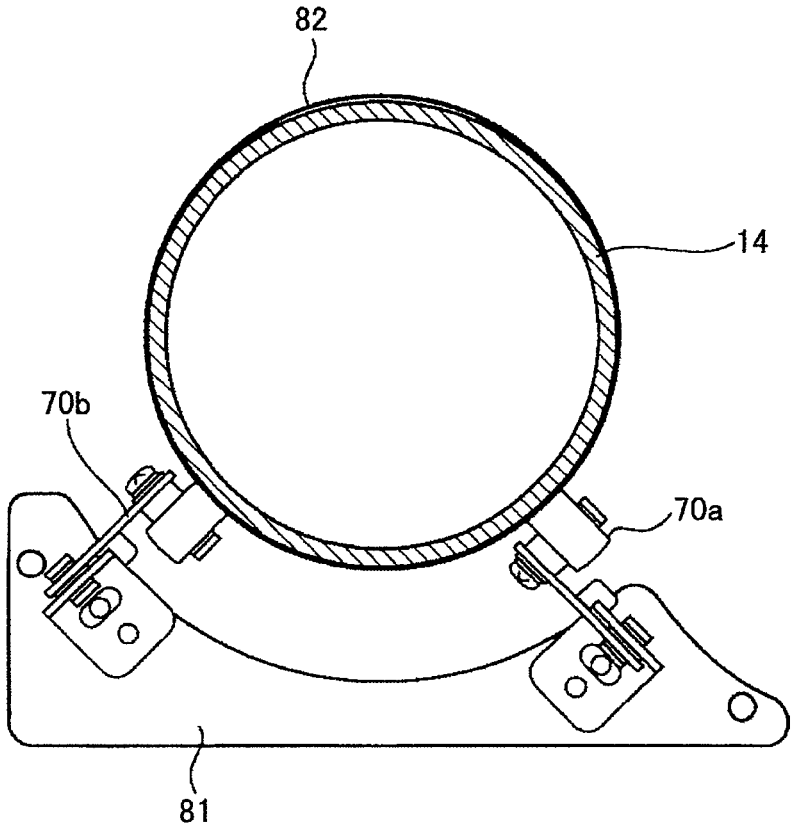
FIG. 13 is a partial cross-sectional view where the heating roller is supported by the two support roller members according to the embodiment of the present invention.

Specifically, the two support roller members 70*a* and 70*b* are provided below the heating roller 14. Moreover, as shown in FIG. 12, assuming that the position of a vertical line 79 passing through the roller center O of the heating roller 14 is defined as 0°, center lines 80 orthogonal to the roller shafts of the support rollers 71*a* and 71*b* are set so as to cross the vertical line 79 at angles in the range from ±30° to ±60°, preferably in the range from ±40° to ±50° (45° in this embodiment). The support roller members 70*a* and 70*b* are arranged symmetrically about the vertical line 79. As shown in FIG. 13, with this arrangement, the support roller members 70*a* and 70*b* stably support the heating roller 14 without interfering with the operation when the heating roller 14 is extracted by the assist unit 40. Therefore, unstable conditions that could occur at the extraction of the heating roller 14 can be eliminated.

Reference numeral 81 in FIG. 12 denotes an attachment plate on which the support roller members 70*a* and 70*b* are provided symmetrically. The support roller members 70*a* and 70*b* are fixed outside the frame 50 through the attachment plate 81 (see FIG. 6).

According to this embodiment, the two support roller members 70 are provided below the heating roller 14. However, about one or two support roller members 70 may also be provided above the heating roller 14. In this case as well, it is necessary to set the upper support roller members 70 at positions so as not to interfere with the extraction of the heating roller 14 by the assist unit 40 in the same manner as the lower support roller members 70*a* and 70*b*. Note that a predetermined amount of gap is required between the upper support roller members 70 and the heating roller 14 so as not to increase a binding force with respect to the heating roller 14.

(Procedure for Replacing Heating Roller)

Next, a description is made of a procedure for replacing the heating roller 14. The heating roller 14 is replaced when it comes to the end of its service life or replaced so as to meet the demands of printers as described above.

Figure 14:
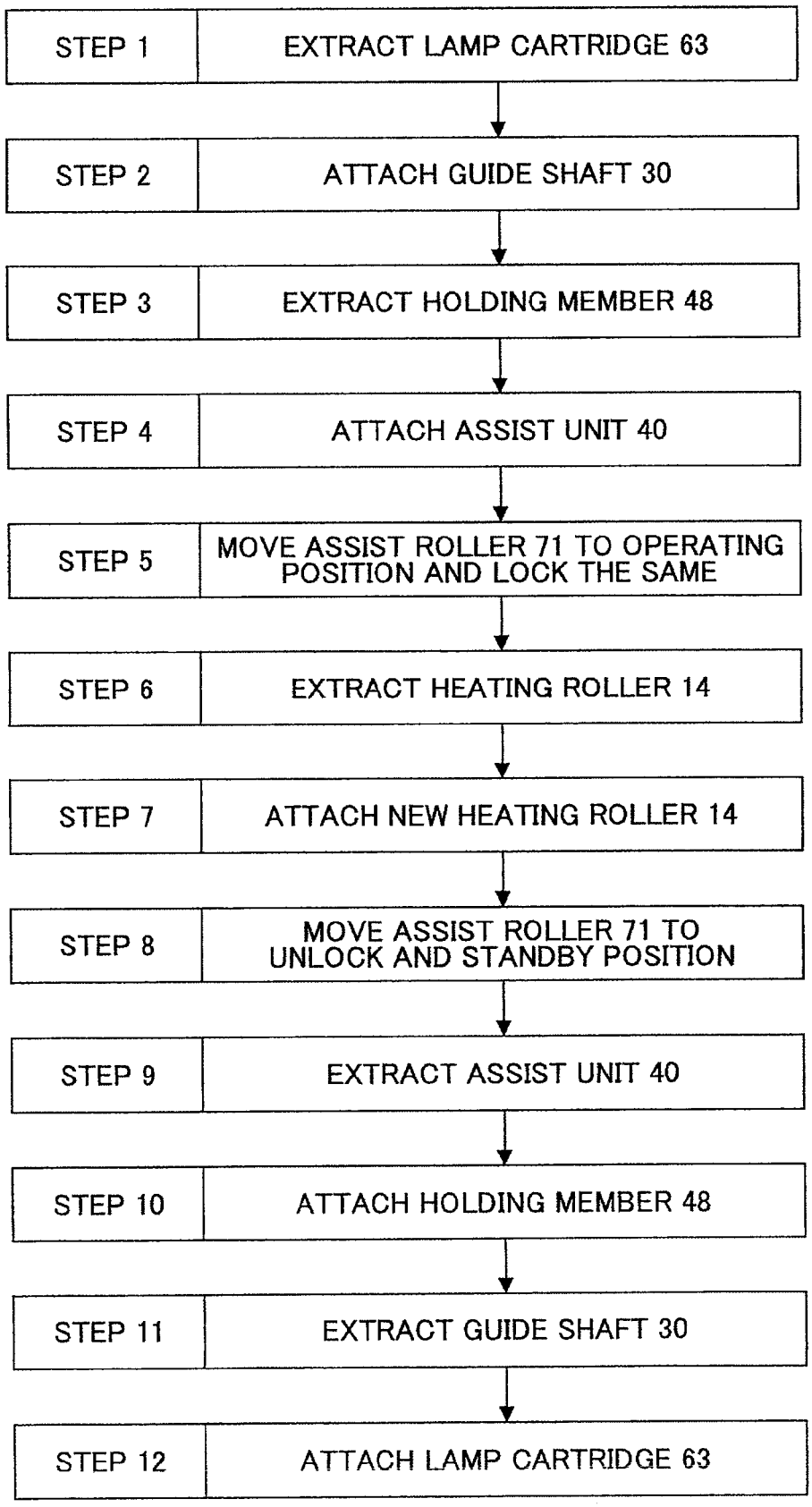
FIG. 14 is a step diagram showing a procedure for replacing the heating roller according to the embodiment of the present invention.

FIG. 14 is a step diagram showing the procedure for replacing the heating roller 14.

As shown in FIG. 14, in step 1, the lamp cartridge 63 is extracted from the inside of the heating roller 14 by the use of the lamp protection member 64. Since this operation is described above with reference to FIG. 5, its duplicated descriptions are omitted here. If the extracted lamp cartridge 63 is left in the lamp protection member 64, it is covered with the rigid lamp protection member 64 having rigidity. Therefore, the lamp cartridge 63 is not carelessly damaged during its replacement operation.

Next, in step 2, as shown in FIG. 6, the roller insertion-and-extraction guide shaft 30 is inserted in the direction as indicated by the arrow B from the through-hole 59*a* of the housing 59. The roller insertion-and-extraction guide shaft 30 is guided and held by the inner cylinder 59*b* of the housing 59, the absorber 14*d*, and the holding member 48. When the insertion of the roller insertion-and-extraction guide shaft 30 reaches a predetermined position, the stopper 31 is inserted in the engagement grooves 30*a* of the roller insertion-and-extraction guide shaft 30, thereby completing the attachment of the roller insertion-and-extraction guide shaft 30.

Then, in step 3, the wing screws 54 are loosened to extract the holding member 48 holding the centering member 46, the bearing 51, the springs 52, the stopper plate 53, and the like in the direction as indicated by the arrow B. At this time, the tip end part of the roller insertion-and-extraction guide shaft 30 is slightly projected outward from the outer side surface of the frame 50. Therefore, along with the guidance of the roller insertion-and-extraction guide shaft 30, the holding member 48 can be smoothly extracted without colliding against the opening end of the frame 50. Note that since the centering member 46 is separated from the heating roller 14 while the holding member 48 is being extracted, the centering member 46 and the bearing 51 are brought into contact with the stopper plate 53 by the restoration force of the springs 52.

Figure 7:
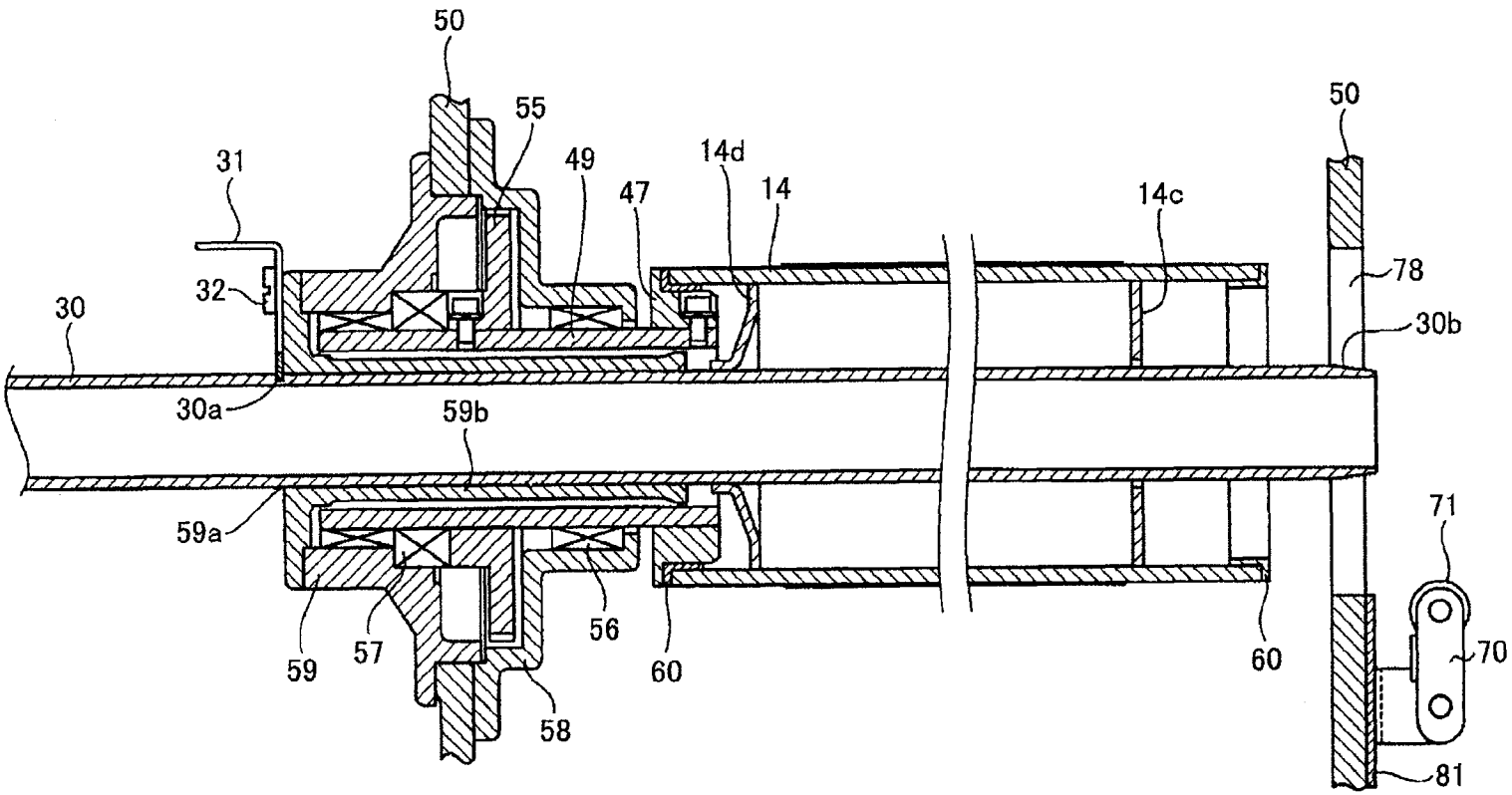
FIG. 7 is a cross-sectional view where one of holding members is extracted from the heating roller in the embodiment of the present invention.

At this time, since the support rollers 71 of the support roller members 70 are on standby (placed at lower positions) as shown in FIG. 6, there occurs no problem in extracting the holding member 48. FIG. 7 shows where the extraction of the holding member 48 from the heating roller 14 is completed.

Figure 16:
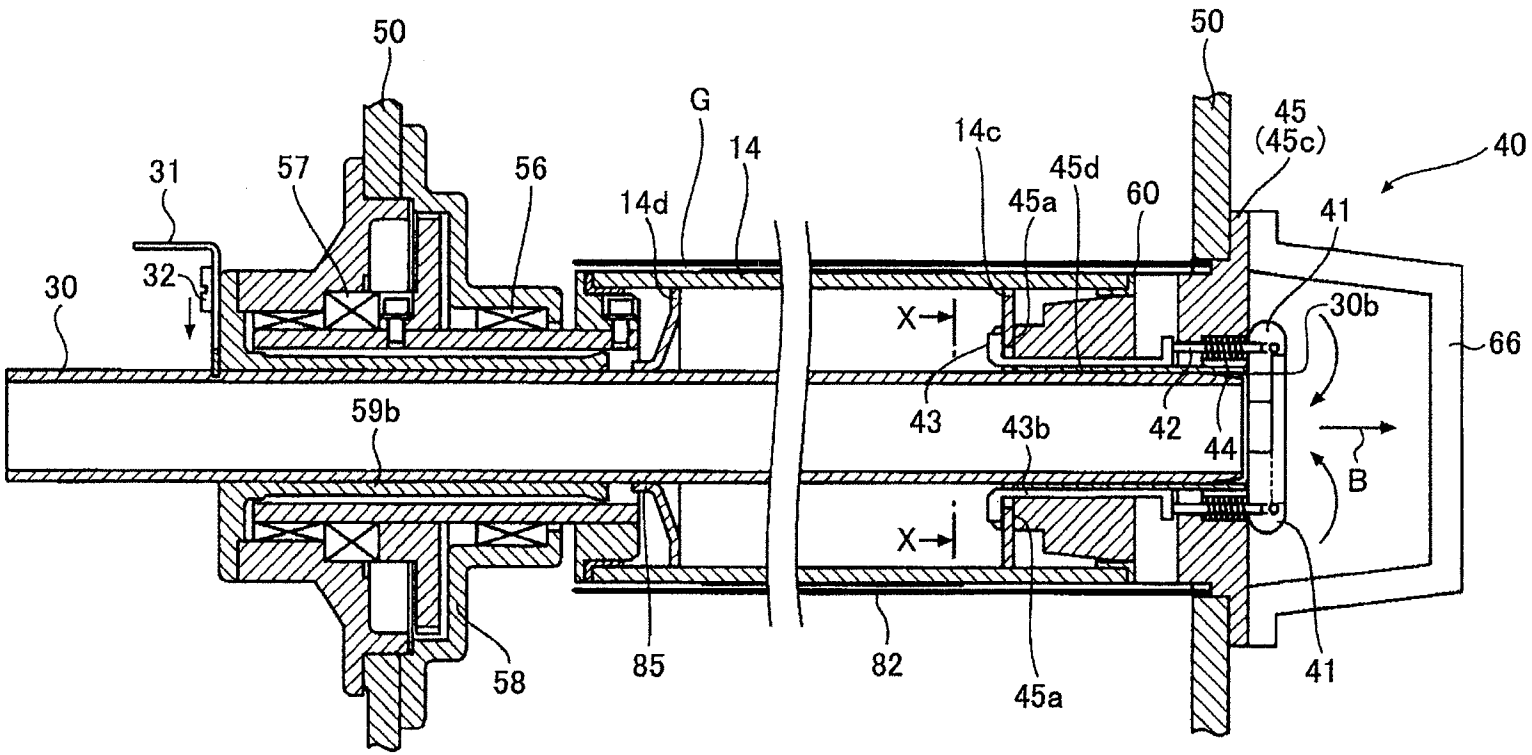
FIG. 16 is a cross-sectional view where the assist unit is attached to the heating roller in the embodiment of the present invention.

Next, in step 4, with the handle 66 being gripped, the assist unit 40 is inserted from the side of the tip end part of the roller insertion-and-extraction guide shaft 30 having the inclination surface 30*b* to cover the outer periphery of the heating roller 14 with the protection member 82 as shown in FIG. 16. When the assist unit 40 is inserted, the lever parts 41 of the latches 41 are mutually directed outward as shown in FIG. 9A. Accordingly, the interval between the inner side surface 45*a* of the unit main body 45 and the holding pieces 43*a* of the holder 43 becomes large as indicated by L1.

Figure 15A:
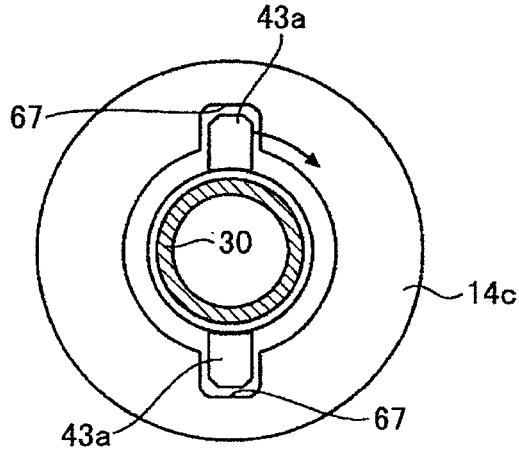
Figure 15B:
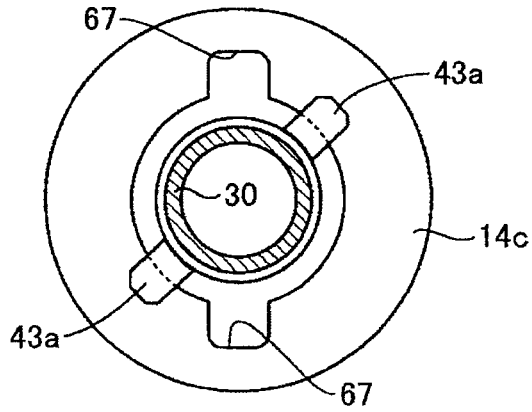

FIGS. 15A and 15B are the diagrams showing the relationship between the absorber 14*c* and the holding pieces 43*a* of the holder 43 as seen from the direction of the arrows X and X in FIG. 16. FIG. 15A is the diagram showing when the assist unit 40 is inserted in the heating roller 14, and FIG. 15B is the diagram showing when the assist unit 40 is attached to the absorber 14*c*.

As shown in FIG. 15A, at the inner peripheral part of the absorber 14*c*, the two cutout parts 67 in which the holding pieces 43*a* of the holder 43 can be inserted are formed so as to be opposite to each other. As shown in FIG. 16, when the assist unit 40 is inserted in the heating roller 14, the holding pieces 43*a* of the holder 43 pass through the cutout parts 67 of the absorber 14*c* and are placed on the left side of the absorber 14*c* in FIG. 16. When the flange 45*c* of the assist unit main body 45 is brought into contact with the outer side surface of the frame 50, the insertion of the assist unit 40 is stopped.

When the assist unit 40 is rotated in the direction as indicated by an arrow in FIG. 15A with the handle 66 being gripped, the holding pieces 43*a* of the holder 43 are disengaged from the cutout parts 67 and face the other inner peripheral part of the absorber 14*c* as shown in FIG. 15B.

When the lever parts 41*c* of the latches 41 are mutually rotated inward as shown in FIG. 9B, the holding pieces 43*a* of the holder 43 are drawn to the side of the assist unit main body 45 through the shafts 42, which in turn elastically holds the inner peripheral part of the absorber 14*c* between the holding pieces 43*a* of the holder 43 and the side surface 45*a* of the assist unit main body 45. Thus, the assist unit 40 is attached to the heating roller 14 through the absorber 14*c*. FIG. 16 shows where the attachment of the assist unit 40 is completed. As shown in FIG. 16, the gap G is formed between the heating roller 14 and the protection member 82, with the result that the protection member 82 does not directly contact the front surface of the heating roller 14.

Next, in step 5, the assist rollers 71 are moved to their operating positions and locked. In order to perform this operation, the roller plate 73 shown in FIG. 11E is rotated by 180 degrees in the direction opposite to arrow F, and hook 76 is fitted in the groove part 77. With this movement, the support rollers 71 face the opening part 78 of the frame 50 as shown in FIG. 17 for replacement purposes.

Then, in step 6, the heating roller 14 at high temperature is extracted from the image forming apparatus with the handle 66 of the assist unit 40 being gripped. At this time, the roller insertion-and-extraction guide shaft 30 is reliably held by the inner cylinder 59*b* of the housing 59, and the inner peripheral part of the absorber 14*d* slides on the outer peripheral surface of the roller insertion-and-extraction guide shaft 30.

Meanwhile, as shown in FIG. 13, a part of the heating roller 14 projected from the frame 50 is stably supported by the support rollers 71*a* and 71*b* through the protection member 82 of the assist unit 40. Along with the extraction of the heating roller 14, the support rollers 71*a* and 71*b* are rotated. FIG. 17 shows the heating roller 14 being extracted.

As described above, the heating roller 14 is covered with the protection member 82*d* having the heat insulation layers 82 at its inner and outer peripheral surfaces. Therefore, it is possible for an operator to safely extract the heating roller 14 at a high temperature of about 200° C. without directly touching the same by hand. Further, as shown in FIG. 10, the heating roller 14 is extracted in a state of being covered with the protection member 82. Therefore, the heating roller 14 never directly contacts other members such as the frame 50 and the support roller 71, which eliminates concerns about scratching the front surface of the heating roller 14. Moreover, stains due to a releasing agent and lubricant oil at the front surface of the heating roller 14 are never attached to other members such as the frame 50 and the support roller 71, which enables the smooth and safe extraction of the heating roller 14.

Note that even after the extraction of the heating roller 14, the centering member 47 and the holding member 49 remain as they are.

Next, in step 7, the assist unit 40 is attached to a new heating roller 14 for replacement (not shown), and the heating roller 14 is loaded by the use of the roller insertion-and-extraction guide shaft 30 together with the assist unit 40. At this time, the support rollers 71*a* and 71*b* are used to enable the smooth insertion of the new heating roller 14 covered with the protection member 82.

Then, in step 8, the support rollers 71*a* and 71*b* are unlocked and moved to their standby positions. This operation is described above with reference to FIGS. 11A through 11F, so that its duplicated descriptions are omitted here.

Next, in step 9, the assist unit 40 is extracted from the heating roller 14. In step 10, the holding member 48 is attached by the use of the roller insertion-and-extraction guide shaft 30. In step 11, the stopper 31 is disengaged to extract the roller insertion-and-extraction guide shaft 30. In step 12, the lamp cartridge 63 covered with the protection member 64 is inserted in the heating roller 14, and then the protection member 64 is extracted from the heating roller 14, thereby completing the attachment of the lamp cartridge 63.

Note that since the attachment of the new heating roller 14 in step 7 is the inverse operation of the extraction of the heating roller 14 in step 6; the extraction of the assist unit 40 in step 9 is the inverse operation of the attachment of the assist unit 40 in step 4; the attachment of the holding member 48 in step 10 is the inverse operation of the extraction of the holding member 48 in step 3; the extraction of the roller insertion-and-extraction guide shaft 30 in step 11 is the inverse operation of the attachment of the roller insertion-and-extraction guide shaft 30 in step 2; and the attachment of the lamp cartridge 63 in step 12 is the inverse operation of the extraction of the lamp cartridge 63 in step 1, their descriptions are omitted here.

Figure 18:
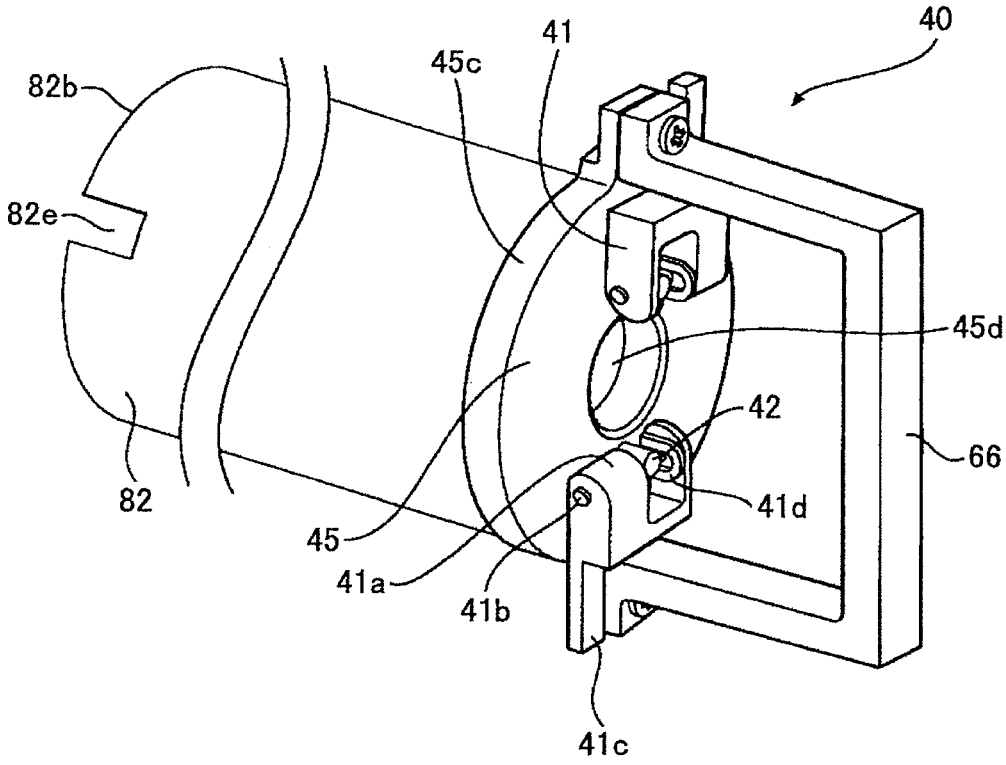
FIG. 18 is a perspective view showing a first modification of the assist unit according to the embodiment of the present invention.

FIG. 18 is a perspective view showing a first modification of the assist unit 40. In this case, the protection member 82 has an escape part 82*e* cut from the opening end 82*b* at a part opposing the connection keys (not shown) on the rear side of the heating roller 14. With the escape part 82*e*, no interference occurs between the protection member 82 and the connection keys on the rear side of the heating roller 14 when the protection member 82 is inserted.

As described in the above section (Structure near Heating Roller), the keys and the keyways on the rear side are provided so as to be shifted by 90° relative to the holder 43 of the assist unit 40 when the assist unit 40 engages with the cutout parts 67 of the absorber 14*c*, i.e., the absorber 14*c*. Thus, using, for example, the position of the holder 43 of the assist unit 40 as an index, the cutout (release part 82*e*) is formed in the protection member 82. Note that since the assist unit 40 is rotated when the holder 43 engages with the cutout parts 67 as described above, the escape part 82*e* is formed in consideration of the rotation of the assist unit 40.

Figure 19:
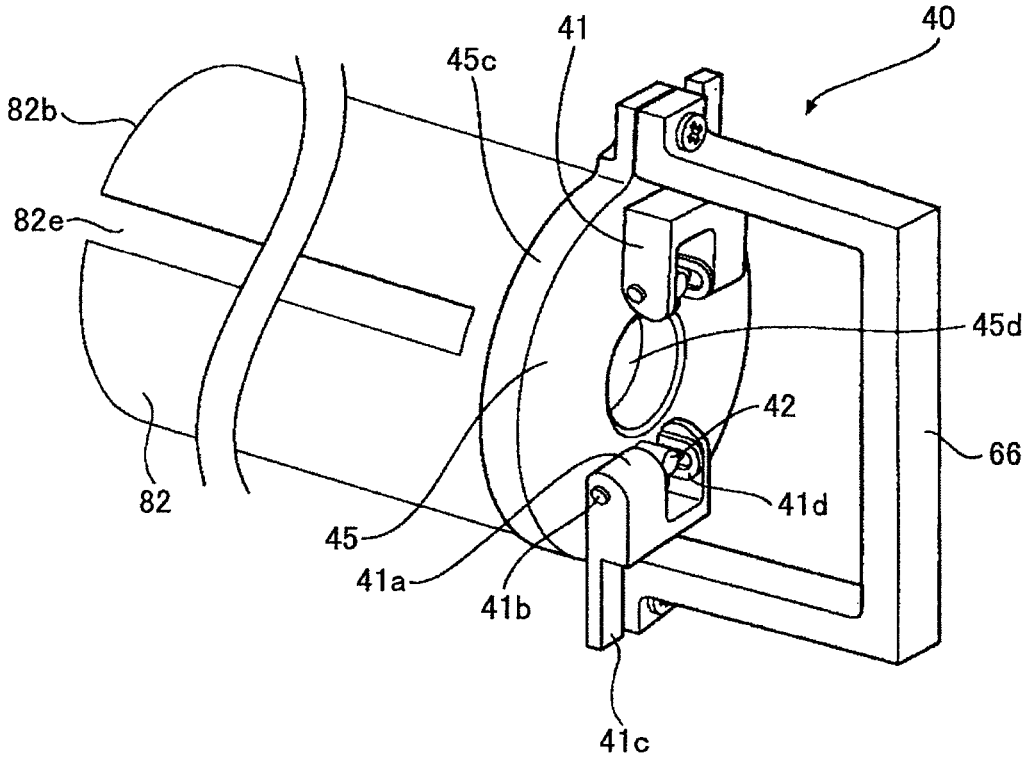
FIG. 19 is a perspective view showing a second modification of the assist unit according to the embodiment of the present invention.

FIG. 19 is a perspective view showing a second modification of the assist unit 40. This modification applies to a case where the heating roller 14 is located near the pressure roller 15 and the pre-heater 13 shown in FIG. 3. In this modification, an escape part 82*e* deeply cut from the opening end 82*b* of the protection member 82 along the shaft direction is formed. With the escape part 82*e*, no interference occurs between the protection member 82 and the pressure roller 15 and the pre-heater 13 when the protection member 82 is inserted.

Note that as in the case of the first modification, it is preferable to set the cutout width of the escape part 82*e* in a circumferential direction as small as possible. In this case as well, the cutout width of the escape part 82*e* in the circumferential direction is defined so that the protection member 82 does not interfere with the pressure roller 15 and the pre-heater 13 due to the rotation of the protection member 82 (the rotation of the assist unit 40).

Note that a detachable cover member that protects the position of the escape part 82*e* of the protection member 82 may be prepared for the purpose of protecting the heating roller 14 at a temporal storage time and may be attached to the protection member 14 at the temporal storage time.

In the above embodiment, the heat insulation layers 82*d* are provided at both of the inner and outer peripheral surfaces of the protection member 82. However, the heat insulation layer 82*d* may also be provided at any of the inner peripheral surface and the outer peripheral surface of the protection member 82.

According to the above embodiment, the replacement of the heating roller 14 is described. However, this embodiment of the present invention can also be applied to the replacement of the pressure roller 15 with or without heat sources.

According to the above embodiment, the heating roller 14 is coated with a releasing agent and lubricant oil. However, this embodiment of the present invention can also be applied to the fixing unit (image forming apparatus) that coats the pressure roller 15 or both the heating roller 14 and the pressure roller 15 with a releasing agent and lubricant oil.

The present invention is not limited to the specifically disclosed embodiments, and variations and modifications may be made without departing from the scope of the present invention.

The present application is based on Japanese Priority Application No. 2010-018762 filed on Jan. 29, 2010, the entire contents of which are hereby incorporated herein by reference.

What is claimed is:

1. A roller replacement auxiliary tool of a fixing unit for extracting at least one of a heating roller and a pressure roller from a replacement opening part formed in a frame of the fixing unit in a shaft direction so as to be replaced, the heating roller having a heater lamp provided therein, the pressure roller being capable of being brought into press-contact with the heating roller, the roller replacement auxiliary tool comprising:

a protection unit that protects the roller when the roller is replaced, wherein:

the protection unit is formed of a protection member that covers an outer peripheral part of the roller to be replaced, the protection unit is formed of a cylindrical protection member that covers an outer peripheral part of the roller to be replaced, and a heat insulation layer is provided on at least one of an inner peripheral surface and an outer peripheral surface of the cylindrical protection member.

2. The roller replacement auxiliary tool of the fixing unit according to claim 1, wherein a roller replacement assist part having an insertion/extraction handle is fixed to one end of the cylindrical protection member.

3. The roller replacement auxiliary tool of the fixing unit according to claim 2, wherein the cylindrical protection member has an escape part cut in the shaft direction from an opening end on a side opposite to the one end to which the roller replacement assist part is connected.

4. The roller replacement auxiliary tool of the fixing unit according to claim 3, wherein the escape part is cut to a position free from interference of a connection member provided in the roller to be replaced.

5. The roller replacement auxiliary tool of the fixing unit according to claim 3, wherein the escape part is cut to a position free from interference of another roller provided near the roller to be replaced in the shaft direction of the cylindrical protection member.

6. The roller replacement auxiliary tool of the fixing unit according to claim 3, wherein the escape part is cut to a position free from interference of a pre-heat unit provided near the roller to be replaced in the shaft direction of the cylindrical protection member.

7. A roller replacement auxiliary tool of a fixing unit for extracting at least one of a heating roller and a pressure roller from a replacement opening part formed in a frame of the fixing unit in a shaft direction so as to be replaced, the heating roller having a heater lamp provided therein, the pressure roller being capable of being brought into press-contact with the heating roller, the roller replacement auxiliary tool comprising:

a protection unit that protects the roller when the roller is replaced, wherein the protection unit is formed of a protection member that covers an outer peripheral part of the roller to be replaced, wherein the protection unit is formed of a cylindrical protection member that covers an outer peripheral part of the roller to be replaced.

* * * * *